United States Patent [19]

Benson

[11] 3,983,914

[45] Oct. 5, 1976

[54] BAG MOUTH OPENER AND SUPPORT

[76] Inventor: Kermit D. Benson, 318 W. 23rd St., Pueblo, Colo. 81003

[22] Filed: Feb. 7, 1975

[21] Appl. No.: 547,923

[52] U.S. Cl. ..... 141/390; 53/384; 93/28

[51] Int. Cl.[2] ..... B65B 67/00

[58] Field of Search ..... 141/390, 312, 316; 53/255, 384; 93/28, 8 R, 35 VL, 1 R

[56] References Cited

UNITED STATES PATENTS

| | | | |
|---|---|---|---|
| 756,693 | 4/1904 | Parr | 141/390 |
| 1,879,410 | 9/1932 | Morris et al. | 141/390 X |
| 2,430,155 | 11/1947 | Buttery | 141/390 |
| 3,822,524 | 7/1974 | Jerpbak | 141/390 X |

*Primary Examiner*—James F. Coan
*Attorney, Agent, or Firm*—W. Britton Moore

[57] ABSTRACT

A device for supporting and holding open the mouth end of a bag during the filling thereof including an elongated, relatively thin, flexible, plastic sheet having hand openings and a series of spaced slots therein and depending locking tabs on one end thereof. Thus, the sheet may be bent into cylindrical form with its edges overlapping and the tabs disposed in those slots which permit the sheet to cylindrically and snugly conform to that of the bag within which it is inserted. When so sleeved within the mouth of a bag, the locking tabs will retain the sheet in assembled position to permit of ready filling thereof, after which the device may be withdrawn and collapsed for reuse.

3 Claims, 2 Drawing Figures

BAG MOUTH OPENER AND SUPPORT

This invention relates to a device which may be bent into cylindrical form and inserted within the mouth of a bag to permit of ready filling thereof.

It is a principal object of the present invention to provide an elongated, relatively thin, flexible, plastic sheet having hand openings and a series of spaced slots generally parallel to one end thereof and depending locking tabs on the other end therof to permit of the sheet being bent in cylindrical form and so retained in locked snugly conforming position during the filling thereof.

Another object is the provision of a sheet having a series of spaced slots in one end thereof and a series of spaced depending locking tabs on the other end thereof whereby the sheet may be readily positioned by the user's hands within and will conform to the mouth of a bag.

Still another object is to provide a relatively inexpensive generally flat sheet which may be so stored, and yet may be quickly bent into cylindrical form and positioned within the mouth end of a bag during the filling thereof, after which the sheet may be withdrawn and unlocked to assume its original flat condition.

While the prior art includes various bag filling devices, such as those to Schofield U.S. Pat. No. 176,555 — Apr. 25, 1876, Mayo U.S. Pat. No. 544,585 Aug. 13, 1895, Dawson U.S. Pat. No. 1,668,053 — May 1, 1928, and Morris et al. U.S. Pat. No. 1,879,410 — Sept. 27, 1932, none of these have been satisfactory or efficient in that they are not readily adaptable to varying size bags, nor are they provided with locking means for securely and adjustably permitting assembly therewithin. In addition, such prior art devices are difficult to assemble and/or store.

Figure 1:
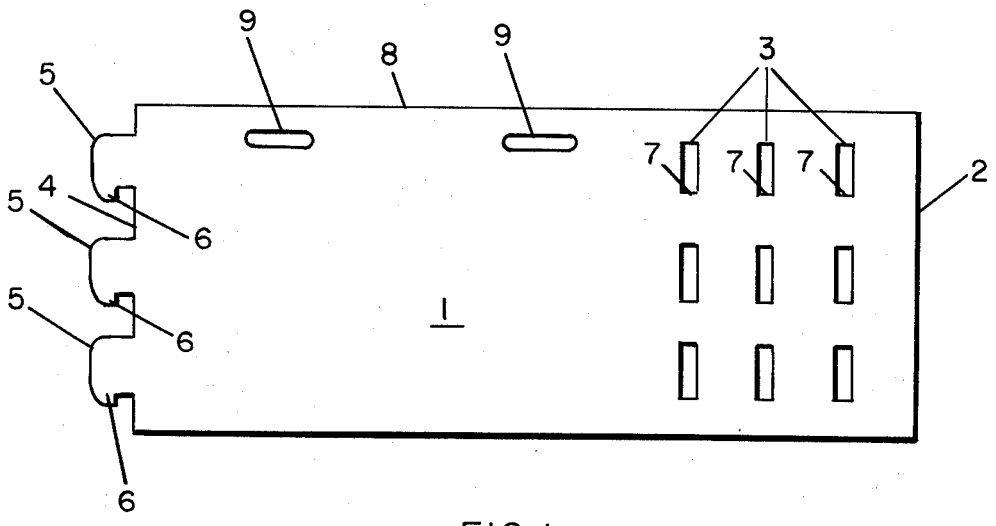
Figure 2:
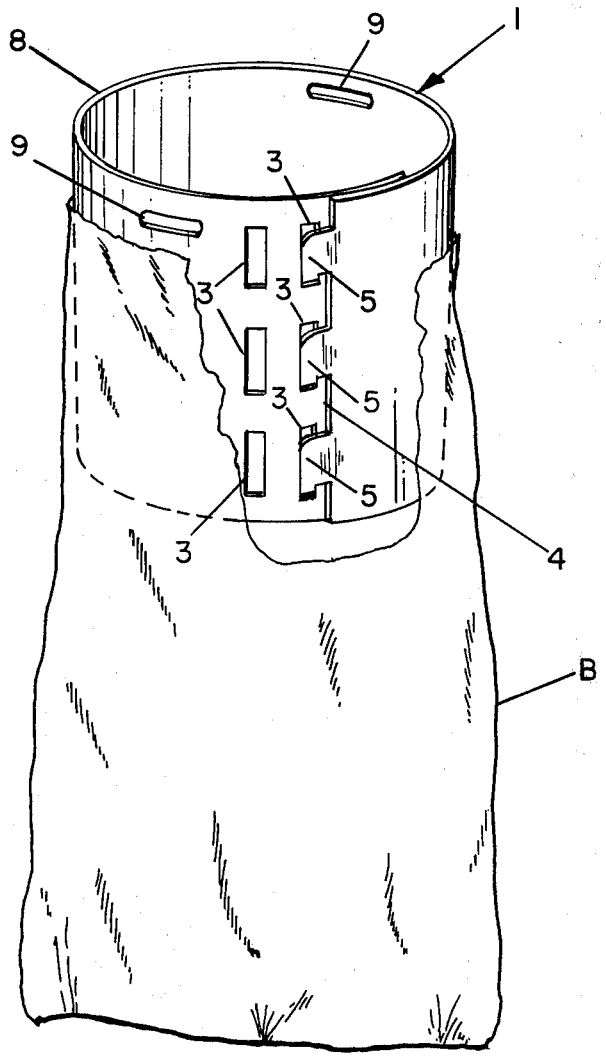

These and various other objects and advantages will be apparent as the specification is considered with the accompanying drawings wherein FIG. 1 is a plan view of a bag mouth opening and supporting device in the generally flat position it assumes prior to assembly within a bag; and FIG. 2 is a perspective view of the device when bent into cylindrical bag opening and supporting form, as mounted in the mouth of a bag.

Referring more particularly to the drawings, wherein similar reference characters designate like parts throughout the several views, an elongated, generally rectangular, relatively thin, and somewhat flexible, sheet 1 of suitable plastic, or metal, is provided with several spaced rows of vertically extending slots 3 adjacent to one end 2 thereof. Three rows of slots each is considered adequate, although this, of course, may be varied, depending upon the degree of circumferential adjustment required, as will hereinafter be explained.

Outwardly and downwardly projecting locking tabs 5, corresponding in number with each row of slots 3, are formed on the opposing end 4 of sheet 1. These tabs may be integrally formed on the sheet, such as when the latter is molded if formed of plastic, shaped by stamping if formed of metal, or otherwise secured by welding or the like. Each tab has a hook-like portion 6 which is adapted to project through the slots 3 in each of the vertical rows thereof so that the hooks 6 will extend downwardly below the lower edges 7 of the slots and thereby retain and lock the sheet in bent cylindrical position of FIG. 2, in an obvious manner.

Horizontally extending spaced openings 9 are formed in sheet 1 slighly below an upper edge 8 thereof and function as hand holds to enable the user to bend sheet 1 into cylindrical form and interlock tabs 5 with slots 3 so that the cylinder may be sleeved within and snugly conform to the mouth of a bag B. It will be apparent that when tabs 5 coact with the first row of slots, the sheet will be of maximum diameter, and may be readily contracted for smaller size bags by being interlocked with the second and third row slots, in an obvious manner.

As sheet 1 is generally flat and somewhat flexible, it may be packaged and stored in flat form, and bent cylindrically for use with a bag. When so cylindrically positioned within a bag, sheet 1 will extend and retain the mouth end of the bag in open position and enable ready filling thereof. When filling has been completed, the cylindrical sheet may be withdrawn therefrom by the user grasping hand openings 9 and the tabs disconnected from the slots so that the sheet reassumes a generally flat position.

While a preferred form of my invention has been shown, various changes and improvements may be made therein without departing from the scope and spirit of the appended claims.

What I claim is:

1. A device for opening and supporting the mouth end of a bag comprising an elongated sheet having hand openings adjacent one edge thereof, a series of rows of spaced transversely extending slots adjacent one end of said sheet and spaced tabs formed integrally on and projecting from the opposing end of said sheet, said tabs having hook-like depending portions thereon and being in alinement with said rows of slots whereby said sheet is bendable and said hook-like portions are insertable in one of said rows of slots and lockable in cylindrical form for sleevable insertion in and for holding open and supporting said bag mouth end.

2. A device for opening and supporting the mouth end of a bag according to claim 1 wherein said sheet is plastic and generally flat.

3. A device for opening and supporting the mouth end of a bag for filling according to claim 2 wherein said sheet is rectangular and said hand openings extend longitudinally of said sheet and are located adjacent one longitudinal edge thereof.

* * * * *